US006659457B1

(12) United States Patent
Cheng

(10) Patent No.: US 6,659,457 B1
(45) Date of Patent: Dec. 9, 2003

(54) PENALTY KICK SOCCER GAME APPARATUS

(76) Inventor: Dara Cheng, 2717 Preece St., San Diego, CA (US) 92111

( * ) Notice: Subject to any disclaimer, the term of this patent is extended or adjusted under 35 U.S.C. 154(b) by 0 days.

(21) Appl. No.: 10/233,383

(22) Filed: Sep. 3, 2002

(51) Int. Cl.[7] ..... A63F 7/06

(52) U.S. Cl. ..... 273/108.53; 273/108.1; 273/129 W; 273/119 R

(58) Field of Search ..... 273/108.1, 108.53, 273/108.55, 129 R, 129 S, 129 T, 129 V, 129 W, 127 R, 127 B, 126 R, 126 A, 119 R, 119 A

(56) References Cited

U.S. PATENT DOCUMENTS 1,820,515 A * 8/1931 Weinberg ..... 273/119 R
3,889,952 A * 6/1975 Shiga ..... 273/126 A
3,970,306 A * 7/1976 Smith, Jr. ..... 273/317.1
6,189,885 B1 * 2/2001 Hamot ..... 273/108.1

FOREIGN PATENT DOCUMENTS

FR 2668712 * 5/1992 ..... A63F/7/06

* cited by examiner

*Primary Examiner*—Raleigh W. Chiu

(57) ABSTRACT

A penalty kick soccer game apparatus for providing a life-like entertaining game for all people to play and enjoy. The penalty kick soccer game apparatus includes a housing having a bottom wall, a tabletop, and side and end walls; and also includes a soccer ball kicking assembly being mounted to the housing; and further includes a goal-defending assembly being mounted to the housing; and further includes a score-keeping member being attached to the housing; and also includes a transparent dome being removably disposed over the tabletop of the housing.

11 Claims, 5 Drawing Sheets

PENALTY KICK SOCCER GAME APPARATUS

BACKGROUND OF THE INVENTION

1. Field of the Invention

The present invention relates to soccer games and more particularly pertains to a new penalty kick soccer game apparatus for providing a life-like entertaining game for all people to play and enjoy.

2. Description of the Prior Art

The use of soccer games is known in the prior art. More specifically, soccer games heretofore devised and utilized are known to consist basically of familiar, expected and obvious structural configurations, notwithstanding the myriad of designs encompassed by the crowded prior art which have been developed for the fulfillment of countless objectives and requirements.

While these devices fulfill their respective, particular objectives and requirements, the aforementioned patents do not disclose a new penalty kick soccer game apparatus. The prior art includes table games having figurines and tabletops upon which the figurines are movably disposed.

SUMMARY OF THE INVENTION

The general providing a life-like entertaining game for all people to play and enjoy of the present invention, which will be described subsequently in greater detail, is to provide a new penalty kick soccer game apparatus which has many of the advantages of the soccer games mentioned heretofore and many novel features that result in a new penalty kick soccer game apparatus which is not anticipated, rendered obvious, suggested, or even implied by any of the prior art soccer games, either alone or in any combination thereof. The present invention includes a housing having a bottom wall, a tabletop, and side and end walls; and also includes a soccer ball kicking assembly being mounted to the housing; and further includes a goal-defending assembly being mounted to the housing; and further includes a score-keeping member being attached to the housing; and also includes a transparent dome being removably disposed over the tabletop of the housing. None of the prior art includes the combination of the elements of the present invention.

There has thus been outlined, rather broadly, the more important features of the penalty kick soccer game apparatus in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the providing a life-like entertaining game for all people to play and enjoy of description and should not be regarded as limiting.

It is an object of the present invention to provide a new penalty kick soccer game apparatus which has many of the advantages of the soccer games mentioned heretofore and many novel features that result in a new penalty kick soccer game apparatus which is not anticipated, rendered obvious, suggested, or even implied by any of the prior art soccer games, either alone or in any combination thereof.

Still another object of the present invention is to provide a new penalty kick soccer game apparatus for providing a life-like entertaining game for all people to play and enjoy.

Still yet another object of the present invention is to provide a new penalty kick soccer game apparatus that is easy and convenient to set up and play.

Even still another object of the present invention is to provide a new penalty kick soccer game apparatus that actually simulates a real life penalty kicking game situation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
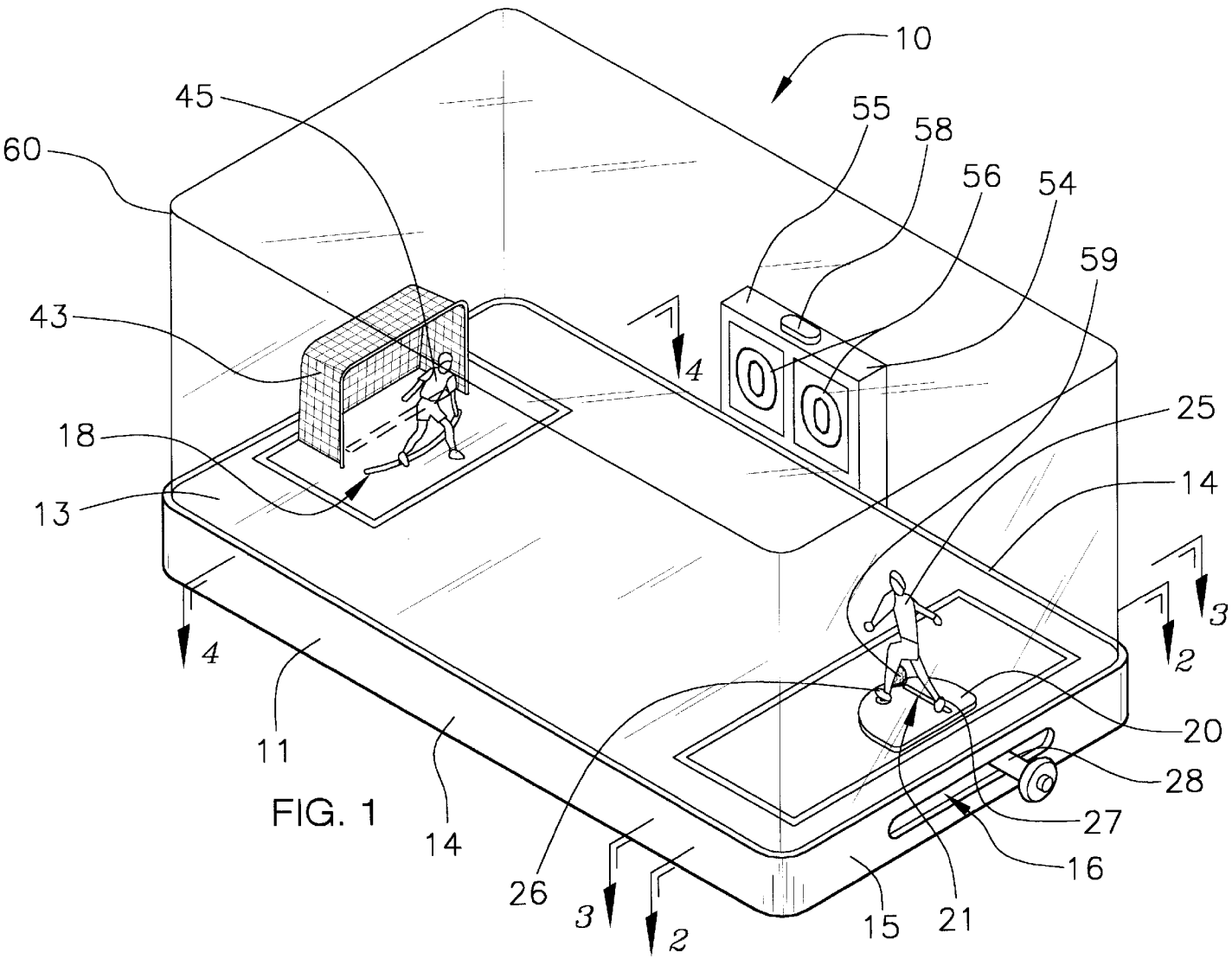
FIG. 1 is a perspective view of a new penalty kick soccer game apparatus according to the present invention.
Figure 2:
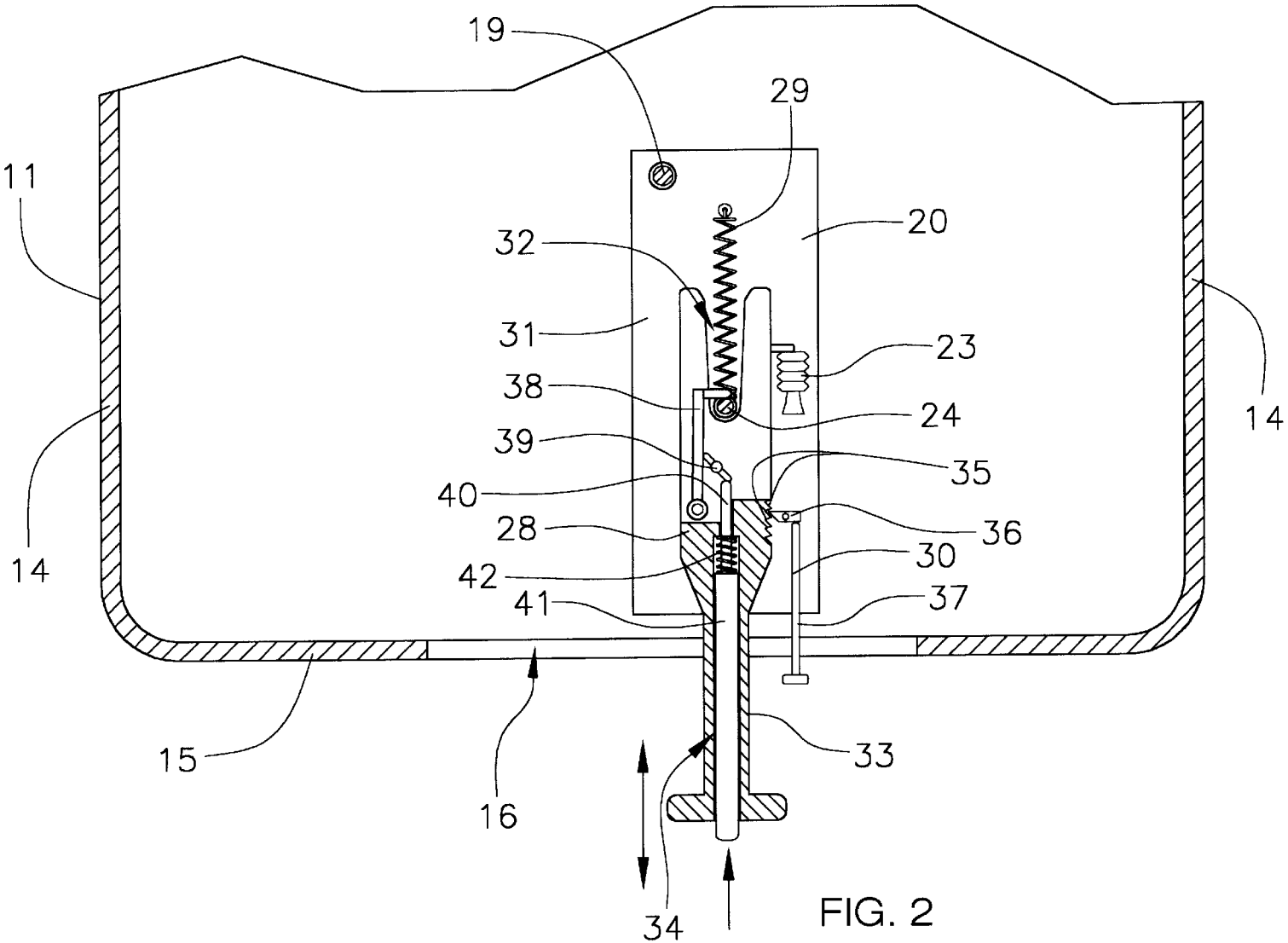
FIG. 2 is a cross-sectional view of the soccer ball kicking assembly of the present invention.
Figure 3:
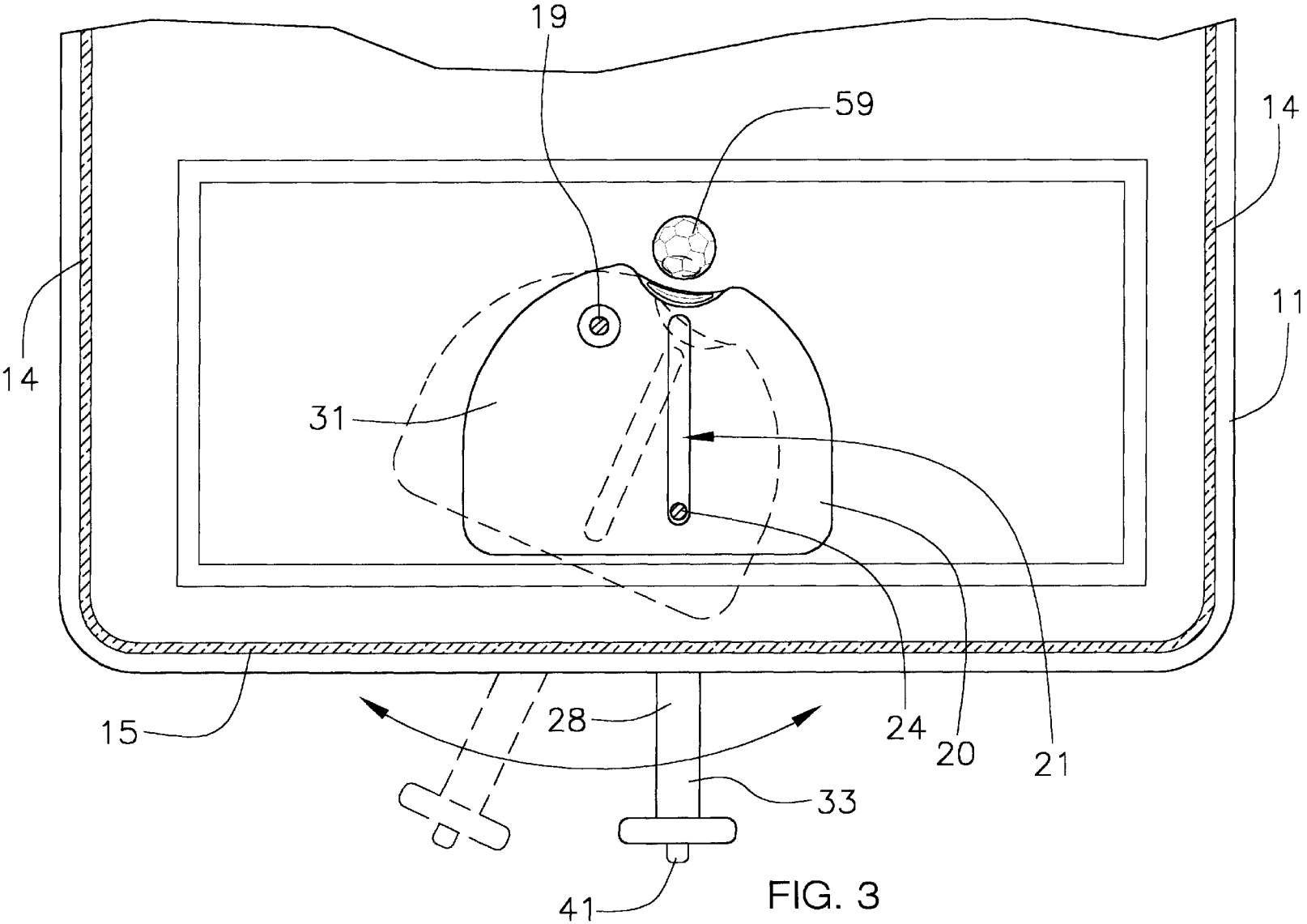
FIG. 3 is another cross-sectional view of the soccer ball kicking assembly of the present invention.
Figure 4:
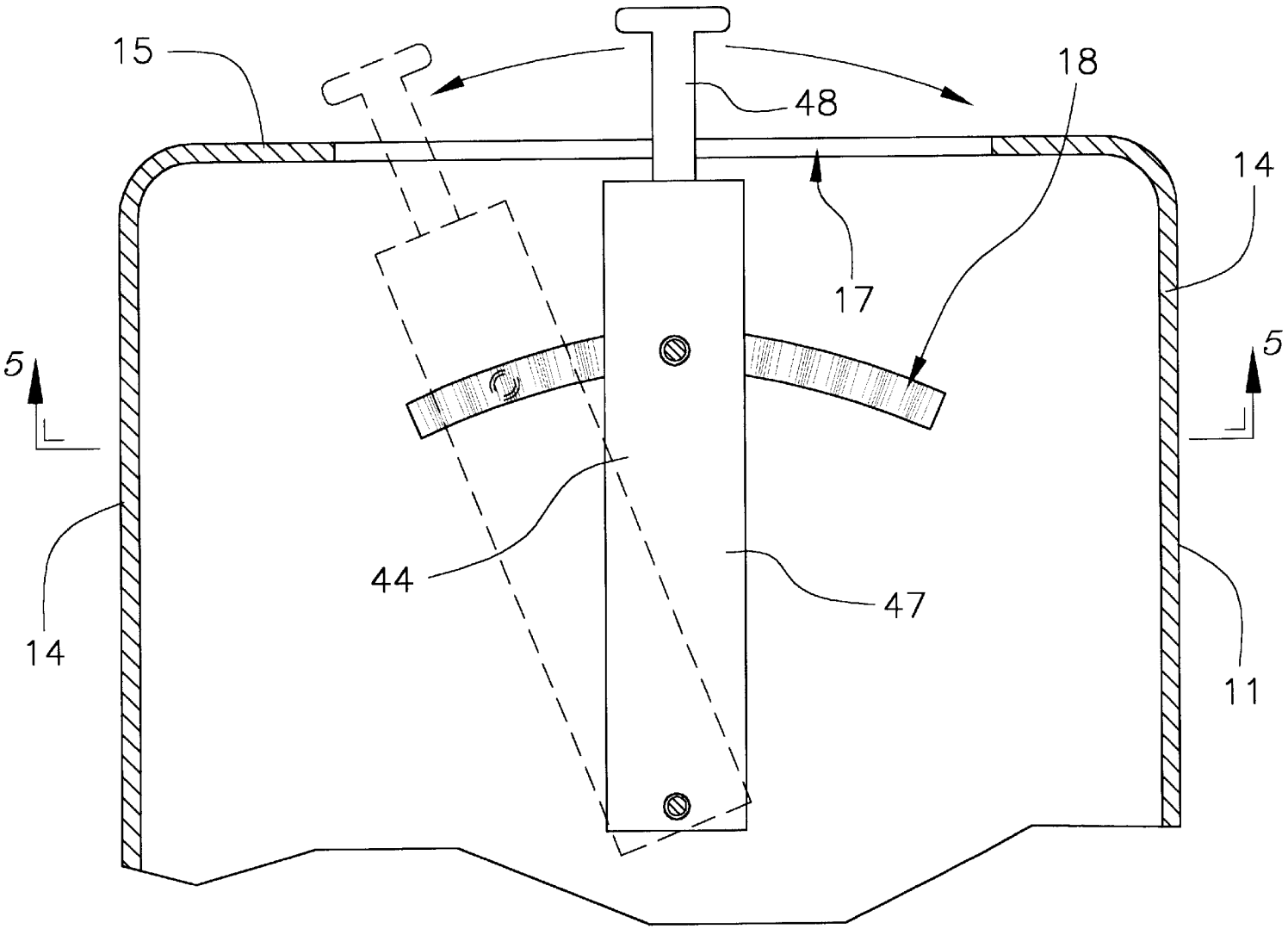
FIG. 4 is a cross-sectional view of the goal-defending assembly of the present invention.
Figure 5:
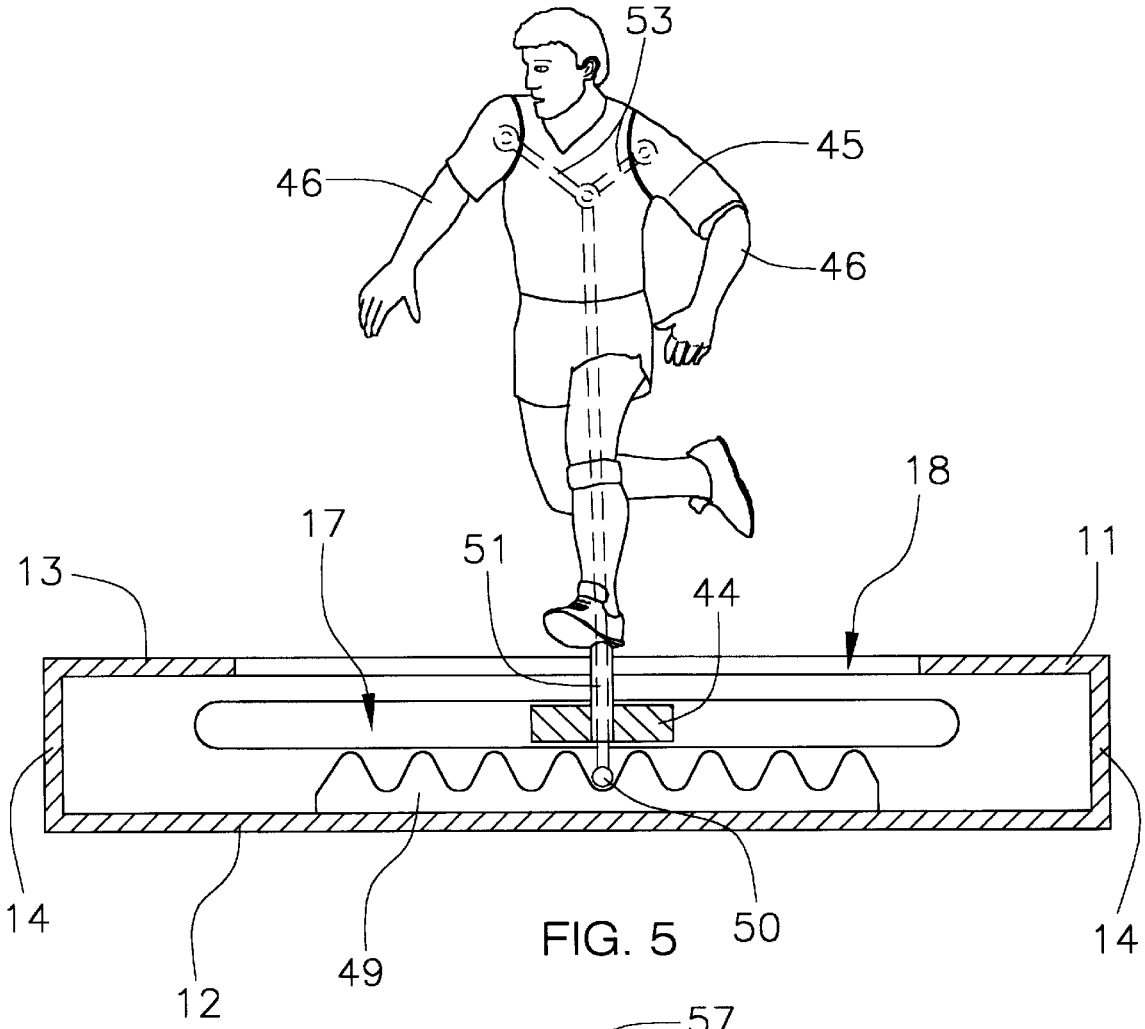
FIG. 5 is another cross-sectional view of the goal-defending assembly of the present invention.
Figure 6:
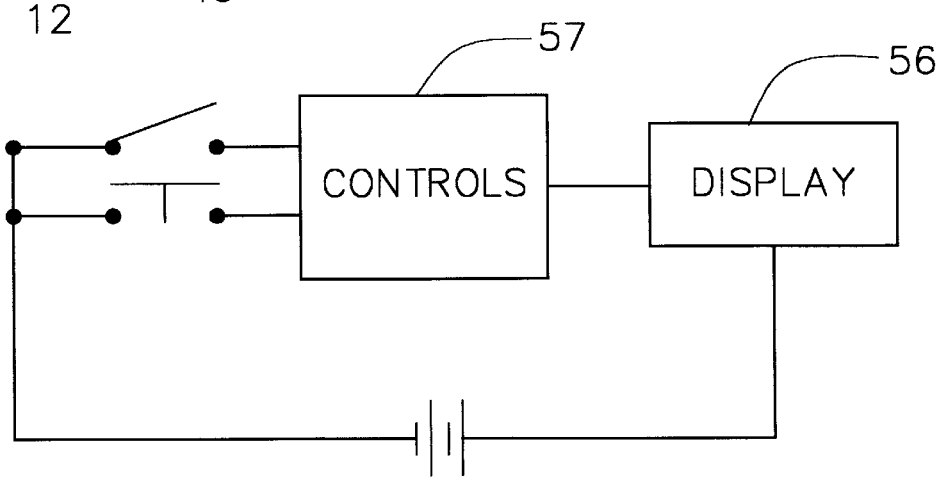
FIG. 6 is schematic diagram of the present invention.

With reference now to the drawings, and in particular to FIGS. 1 through 6 thereof, a new penalty kick soccer game apparatus embodying the principles and concepts of the present invention and generally designated by the reference numeral 10 will be described.

As best illustrated in FIGS. 1 through 6, the penalty kick soccer game apparatus 10 generally comprises a housing 11 having a bottom wall 12, a tabletop 13, and side and end walls 14, 15. The housing 11 includes first and second elongate slots 16, 17 being disposed through the end walls 15, and also includes an arcuate slot 18 being disposed through the tabletop 13 near a second end thereof, and further includes an opening in the tabletop 13 near a first end thereof.

A soccer ball kicking assembly is conventionally mounted to the housing 11. The soccer ball kicking assembly includes a plate support member 19 being conventionally attached to the bottom wall 12 of the housing 11 and being disposed in the opening of the tabletop 13, and also includes a plate 20 being pivotally and conventionally attached to the plate support member 19 and having an elongate slot 21 being disposed therethrough, and further includes a ball striker member being conventionally mounted upon the plate 20, and further includes a trigger assembly being conventionally attached to the plate 20 for actuating the ball striker member, and also includes a whistle member 23 being conventionally mounted to the plate 20 and being actuated upon the ball 59 being struck with the ball striker member. The ball striker member includes a slider 24 being movably and conventionally disposed in the elongate slot 21 of the plate 20, and also includes a soccer player figurine 25 having a body, head, arms, a first leg 26 being securely and conventionally attached to a ball striker support member 22 which is conventionally attached to the plate 20, and also having a second leg 27 being movably and conventionally attached to the slider 24 for striking the ball 59 played upon the tabletop 13. The trigger assembly includes a lever 28 being slidably and conventionally disposed in the housing 11 below the plate 20, and also includes a first spring 29 having a first end being attached to the plate 20 and having a second end being attached to the slider 24 to move the slider 24 to strike the ball 59, and further includes a lever latching member 30 being engagable to the lever 28 for locking and securing the lever 28 so that the ball striker member is in a ball striking ready position, and also includes a slider release assembly being conventionally mounted to the lever 28 and being engagable to the slider 24. The lever 28 includes a slider support portion 31 having an elongate slot 32 being disposed through an end thereof for receiving and guiding the slider 24, and also includes a tubular handle portion 33 having a bore 34 extending therethrough and also having open first and second ends and further having a rim being disposed about the open first end, and further includes teeth 35 being conventionally disposed along an exterior of the lever 28. The lever latching member 30 includes a pawl 36 being pivotally and conventionally attached to the plate 20 and being engagable to the teeth 35 of the lever 28, and also includes a shaft 37 being movably attached to the plate 20 and being extended through the first elongate slot 16 of the housing 11 and also being in contactable relationship with the pawl 36 for pivoting the pawl 36 to engage and disengage the teeth 35 of the lever 28. The slider release assembly includes an elongate slider release member 38 having a main shaft portion and an end portion being angled relative to the main shaft portion for holding the slider 24, and also includes a first linkage 39 being pivotally attached to the plate 20 and being engagable to the elongate slider release member 38, and further includes a second linkage 40 being in contactable relationship to the first linkage 39, and also includes an elongate actuating shaft member 41 being movably disposed in and through the bore 34 of the tubular handle portion 33 and being in contactable relationship with the second linkage 40, and further includes a second spring 42 being disposed about the second linkage 40 for biasing the elongate actuating shaft member 41 through the open end of the tubular handle portion 33.

A goal-defending assembly is conventionally mounted to the housing 11. The goal-defending assembly includes a goal 43 being a net structure and being attached upon the tabletop 13 at the second end of the housing 11, and also includes a control lever 44 being pivotally disposed in the housing 11 and being disposed through the second elongate slot 17, and further includes a goal protector assembly including a goal-tending support assembly being disposed in and upon the housing 11 and also including a goal-tending figurine 45 being movably mounted upon the goal-tending support assembly for protecting the goal 43 and preventing the ball 59 from getting into the goal 43. The control lever 44 has a plate portion 47 and a handle portion 48 extending through the second elongate slot 17. The goal-tending support assembly includes a strip of cams 49 being conventionally disposed in the housing 11, and also includes a cam follower 50 being movably disposed upon the strip of cams 49, and further includes a support shaft 51 being attached to the cam follower 50 and being disposed through the arcuate slot 18 of the tabletop 13 and being disposed through a leg of the goal-tending figurine 45, and also includes linkage members 53 being pivotally attached to the support shaft 51 and being disposed in arms 46 of the goal-tending figurine 45 for moving the arms 46 upon the cam follower 50 being moved along the strip of cams 49.

A score-keeping member 54 is conventionally attached to the housing 11. The score-keeping member 54 includes a display unit 55 including a display screen 56 and being attached to the housing 11, and also includes a microprocessor 57 being disposed in the display unit 55, and further includes a control switch 58 being attached to the display unit 55 and being connected to the microprocessor 57 and to a power source such as a battery for controlling the display screen 56.

A transparent dome 60 is removably disposed over the tabletop 13 of the housing 11.

In use, the user places the ball 59 upon the plate 20 and the user moves the slider 24 into a striking ready position using the lever 28, and releases the slider 24 so that it strikes the all 59 with a second user attempting to block the ball 59 from entering the goal 43 by the second user controlling the goal-tending figurine 45 with the control lever 44.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the penalty kick soccer game apparatus. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A penalty kick soccer game apparatus comprising:

a housing having a bottom wall, a tabletop, and side and end walls, said housing including first and second elongate slots being disposed through said end walls, and also including an arcuate slot being disposed through said tabletop near a second end thereof, and further including an opening in said tabletop near a first end thereof;

a soccer ball kicking assembly being mounted to said housing;

a goal-defending assembly being mounted to said housing;

a score-keeping member being attached to said housing; and a transparent dome being removably disposed over said tabletop of said housing.

2. A penalty kick soccer game apparatus as described in claim 1, wherein said soccer ball kicking assembly includes a plate support member being attached to said bottom wall of said housing and being disposed in said opening of said tabletop, and also includes a plate being pivotally attached to said plate support member and having an elongate slot being disposed therethrough, and further includes a ball striker member being mounted upon said plate, and further includes a trigger assembly being attached to said plate for actuating said ball striker member, and also includes a whistle member being mounted to said plate and being actuated upon the ball being struck with said ball striker member.

3. A penalty kick soccer game apparatus as described in claim 2, wherein said ball striker member includes a slider being movably disposed in said elongate slot of said plate, and also includes a soccer player figurine having a body, head, arms, a first leg being securely attached to a ball striker support member which is attached to said plate, and also having a second leg being movably attached to said slider for striking a ball played upon said tabletop.

4. A penalty kick soccer game apparatus as described in claim 3, wherein said trigger assembly includes a lever being slidably disposed in said housing below said plate, and also includes a first spring having a first end being attached to said plate and having a second end being attached to said slider for moving said slider to strike the ball, and further includes a lever latching member being engageable to s aid lever for locking and securing said lever so that said ball striker member is in a ball striking ready position, and also includes a slider release assembly being mounted to said lever and being engageable to said slider.

5. A penalty kick soccer game apparatus as described in claim 4, wherein said lever includes a slider support portion having an elongated slot being disposed through an end thereof for receiving and guiding said slider, and also includes a tubular handle portion having a bore extending therethrough and also having open first and second ends and further having a rim being disposed about said open first end, and further includes teeth being disposed along an exterior of said lever.

6. A penalty kick soccer game apparatus as described in claim 5, wherein said lever latching member includes a pawl being pivotally attached to said plate and being engageable to said teeth of said lever, and also includes a shaft being movably attached to said plate and being extended through said first elongate slot of said housing and also being in contactable relationship with said pawl for pivoting said pawl into engagement and disengagement with said lever.

7. A penalty kick soccer game apparatus as described in claim 6, wherein said slider release assembly includes an elongate slider release member having a main shaft portion and an end portion being angled relative to said main shaft portion for holding said slider, and also includes a first linkage being pivotally attached to said plate and being engageable to said elongate slider release member, and further includes a second linkage being in contactable relationship to said first linkage, and also includes an elongate actuating shaft member being movably disposed in and through said bore of said tubular handle portion and being in contactable relationship with said second linkage, and further includes a second spring being disposed about said second linkage for biasing said elongate actuating shaft member through said open end of said tubular handle portion.

8. A penalty kick soccer game apparatus as described in claim 7, wherein said goal-defending assembly includes a goal being a net structure and being attached upon said tabletop at said second end of said housing, and also includes a control lever being pivotally disposed in said housing and being disposed through said second elongate slot, and further includes a goal protector assembly including a goal-tending support assembly being disposed in and upon said housing and also including a goal-tending figurine being movably mounted upon said goal-tending support member for protecting said goal and preventing the ball from getting into said goal.

9. A penalty kick soccer game apparatus as described in claim 8, wherein said control lever has a plate portion and a handle portion extending through said second elongate slot.

10. A penalty kick soccer game apparatus as described in claim 9, wherein said goal-tending support assembly includes a strip of cams being disposed in said housing, and also includes a cam follower being movably disposed upon said strip of cams, and further includes a support shaft being attached to said cam follower and being disposed through said arcuate slot of said tabletop and being disposed through a leg of said goal-tending figurine, and also includes linkage members being pivotally attached to said support shaft and being disposed in arms of said goal-tending figurine for moving said arms upon said cam follower being moved along said strip of cams.

11. A penalty kick soccer game apparatus as described in claim 10, wherein said score-keeping member includes a display unit including a display screen and being attached to said housing, and also includes a microprocessor being disposed in said display unit, and further includes a control switch being attached to said display unit and being connected to said microprocessor and to a power source such as a battery for controlling said display screen.

* * * * *